US011503931B2

(12) United States Patent
Emdadi et al.

(10) Patent No.: US 11,503,931 B2
(45) Date of Patent: Nov. 22, 2022

(54) SEPARATABLE PILLOW

(71) Applicant: Kamran Emdadi, Virginia Beach, VA (US)

(72) Inventors: Kamran Emdadi, Virginia Beach, VA (US); Bryce Adam Wells, Virginia Beach, VA (US)

( * ) Notice: Subject to any disclaimer, the term of this patent is extended or adjusted under 35 U.S.C. 154(b) by 0 days.

(21) Appl. No.: 16/815,944

(22) Filed: Mar. 11, 2020

(65) Prior Publication Data

US 2020/0288893 A1 Sep. 17, 2020

Related U.S. Application Data

(60) Provisional application No. 62/931,703, filed on Nov. 6, 2019, provisional application No. 62/816,245, filed on Mar. 11, 2019.

(51) Int. Cl.
*A47G 9/10* (2006.01)
*A47C 16/00* (2006.01)

(52) U.S. Cl.
CPC ..... *A47G 9/1081* (2013.01); *A47C 16/00* (2013.01)

(58) Field of Classification Search
CPC .... A47G 9/1081; A47G 9/1054; A47G 9/109; A47G 9/1063; A47C 7/383; A47C 16/00; A47D 13/083
See application file for complete search history.

(56) References Cited

U.S. PATENT DOCUMENTS

| | | | | |
|---|---|---|---|---|
| 3,273,174 | A * | 9/1966 | Cassini | A47G 9/10 D6/601 |
| 7,185,378 | B2 * | 3/2007 | Smith | A45C 13/26 128/DIG. 23 |
| 10,918,229 | B1 * | 2/2021 | Mello | A47G 9/04 |
| 2010/0175192 | A1 * | 7/2010 | Aiken | A47C 20/021 5/632 |
| 2016/0007756 | A1 * | 1/2016 | Hauer | A47C 7/383 5/644 |
| 2018/0263389 | A1 * | 9/2018 | Lee | A47G 9/1081 |
| 2020/0093294 | A1 * | 3/2020 | Ban | A47G 9/10 |
| 2020/0146476 | A1 * | 5/2020 | Johnson | A47C 7/723 |
| 2021/0000266 | A1 * | 1/2021 | Breen | A47C 20/021 |

* cited by examiner

*Primary Examiner* — Peter M. Cuomo
*Assistant Examiner* — Alison N Labarge

(57) ABSTRACT

One example may include a main pillow body and one or more separatable pillow body extensions affixed to the main pillow body by an affixing surface on one or more ends of the main pillow body.

3 Claims, 8 Drawing Sheets

SEPARATABLE PILLOW

CROSS-REFERENCE TO RELATED APPLICATIONS

This application claims priority to earlier filed provisional patent application No. 62/816,245 entitled "SEPARATABLE PILLOW" filed on Mar. 11, 2019 and provisional patent application No. 62/931,703 entitled "SEPARATABLE PILLOW" filed on Nov. 6, 2019, both of which are hereby incorporated by reference in their entireties.

TECHNICAL FIELD OF THE APPLICATION

This application relates to a pillow and more particularly to a pillow that has multiple pillow parts which can be affixed together or come apart and re-positioned in other arrangements.

BACKGROUND OF THE APPLICATION

Conventionally, pillows are one piece of foam or a voluminous cavity which can be stuffed with cotton, synthetic materials, feathers, etc. The travel pillow era has invited all sorts of small U-shaped pillows which can be hung on one's neck and are supposed to provide support while traveling in a transport. The reality is those pillows have poor clearance and do not reach one's chin or jawline and leave travelers with not much support when they are forced to sleep in compromising positions unlike when they are at home sleeping in their flat beds with larger pillows. Travel is already a burden and the ability to sleep on a plane or train or in a car should not be further complicated by a pillow with no support.

Also, the contour of peoples' faces should be taken into consideration by the pillow design to not put added pressure on their jaw bones or jaw and facial muscles while providing the desired support.

SUMMARY OF THE APPLICATION

One example embodiment may include a pillow that includes a main pillow body, and one or more separatable pillow body extensions affixed to the main pillow body by an affixing surface on one or more ends of the main pillow body.

Still yet another example embodiment may include a pillow that includes a substantially cylindrical main pillow body loop with an opening where both ends of the main pillow body end, and separatable pillow body extensions affixed to the main pillow body at both ends of the main pillow body.

DETAILED DESCRIPTION OF THE APPLICATION

It will be readily understood that the components of the present application, as generally described and illustrated in the figures herein, may be arranged and designed in a wide variety of different configurations. Thus, the following detailed description of the embodiments of an apparatus, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
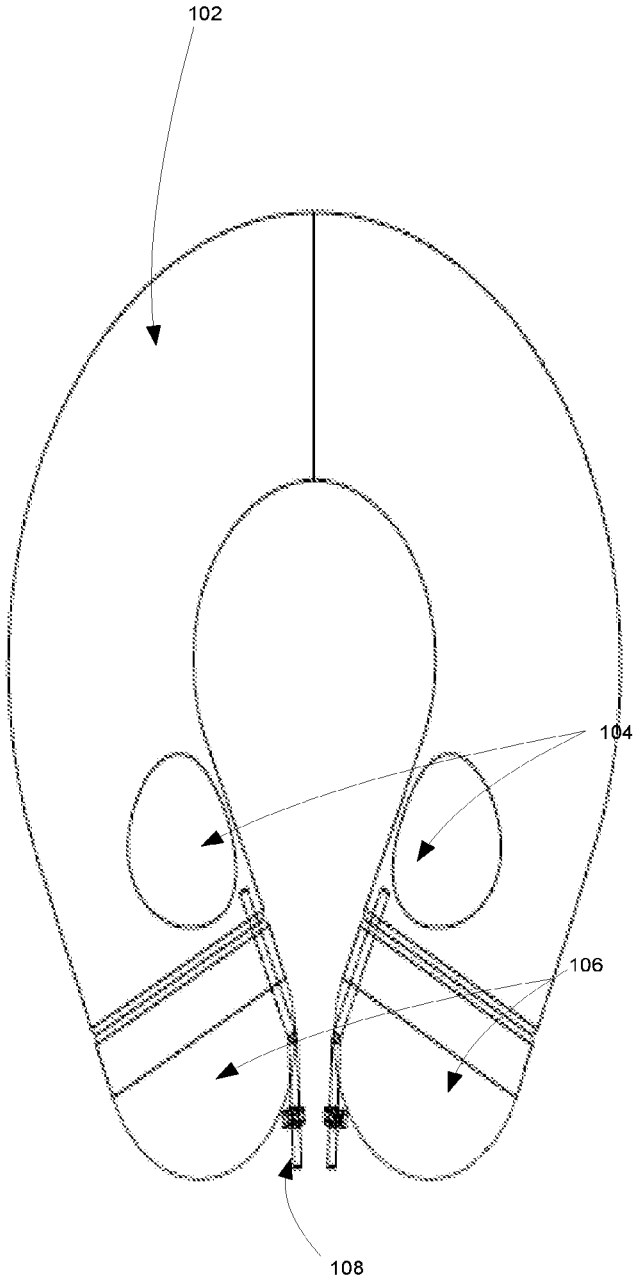
FIG. 1 illustrates a top view of the main pillow and pillow extensions joined together according to example embodiments.

FIG. 1 illustrates a top view of the main pillow and pillow extensions joined together according to example embodiments. Referring to FIG. 1, the main pillow body 102 is a substantially cylindrical foam and/or other material type of cushion body with a layer of material on the outside for aesthetic purposes. The ends of the main body 102 may have two or more affixing surfaces 104, such as VELCRO, magnets, snaps, etc. A securing cord 108 provides a way to lock the main body together to keep the ends of the main body together so a neck can rest on the pillow without slipping off as a person's head shifts around. The securing cords may be in the inside of the main body or on the outside. Also, in one example the extensions 106 are removed and have a securing/affixing surface that contacts the alternative affixing surface 104. The extension(s) 106 then is held in place against the affixing surface 104. Ideally, one would place a single extension 106 against their neck on one side of the affixing surface 104 and the other extension 106 under their elbow on the hard and uncomfortable surface of an airplane arm rest or any hard armrest of any vehicle. However, placing both end pieces 106 on the alternative securing surfaces 104 is another option.

Figure 2:
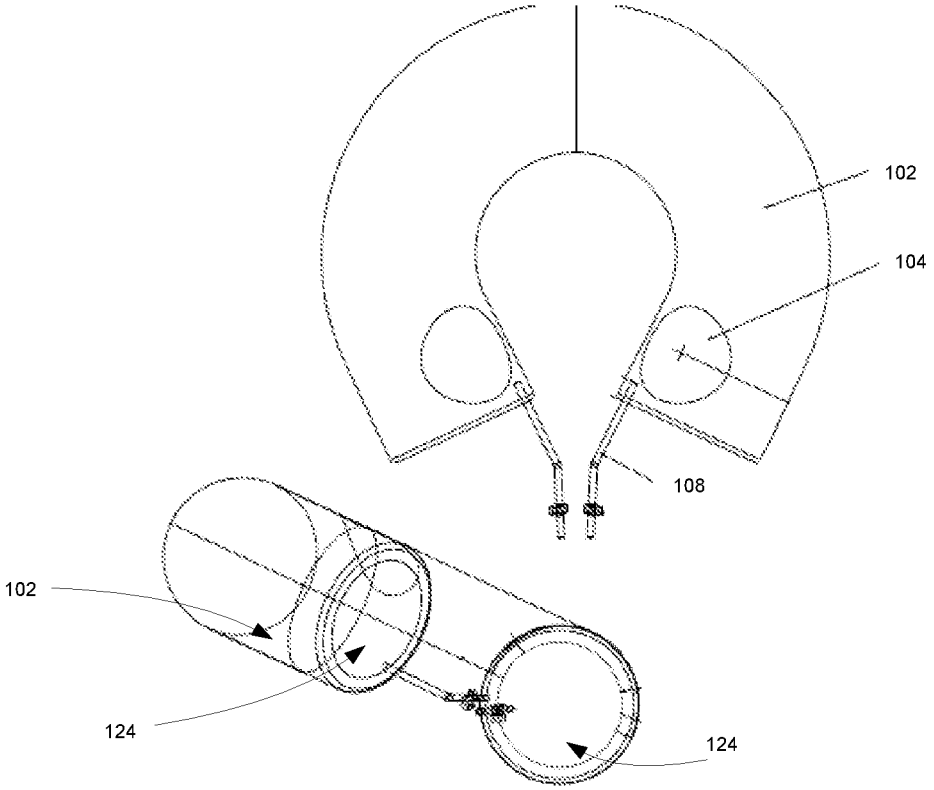
FIG. 2 illustrates a top view of the main pillow with the pillow extensions separated according to example embodiments.

FIG. 2 illustrates a top view of the main pillow and pillow extensions separated according to example embodiments. Referring to FIG. 2, in this example the extensions 106 have been separated from the main body 102 to expose the affixing surfaces 124. In this arrangement the extensions 106 can be re-secured back onto the ends of the main pillow body, placed on the alternative affixing surfaces 104 of the main pillow body or placed elsewhere, such as against an arm rest, a window, the airplane interior wall for head support, etc. When the end pillows 106 are removed, the tie strings 108 can be tightened via a cord lock to keep the pillow from slipping off one's neck and shoulder.

Figure 3:
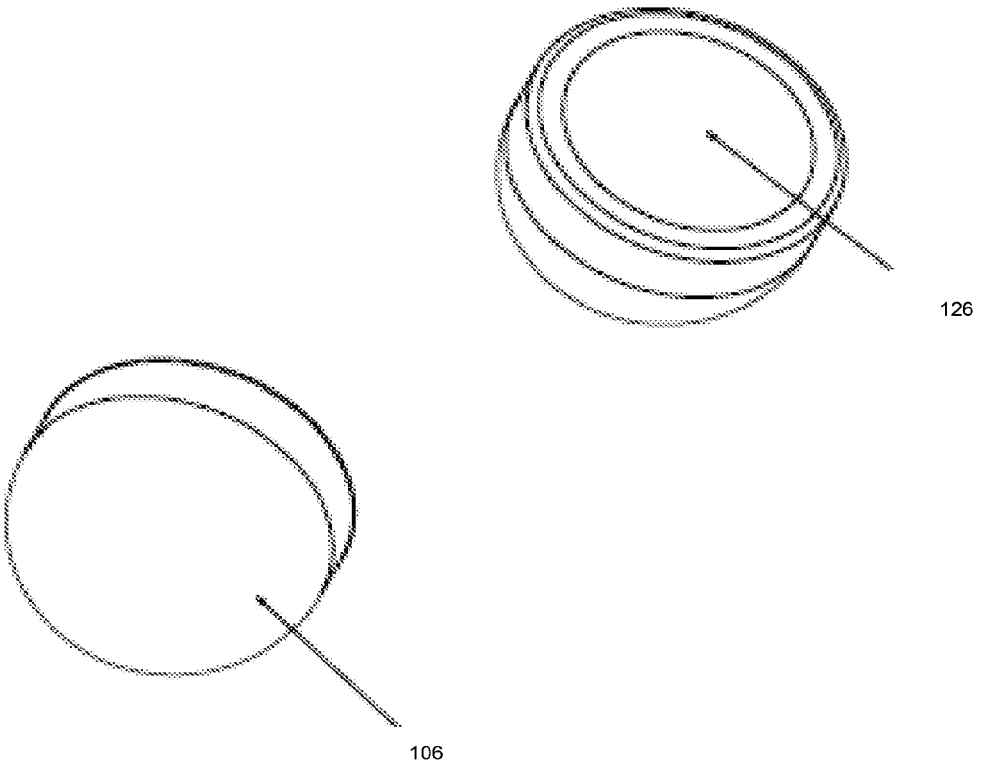
FIG. 3 illustrates side views of the pillow extensions without the main pillow body according to example embodiments.

FIG. 3 illustrates side views of the pillow extensions joined together according to example embodiments. In FIG. 3, the shape and dimensions of the pillow end pieces 106 are shown to be similar to a half-sphere, although a little longer according to one example. The end pieces 106 should be large enough that one's elbow does not push through the cushion's spring coefficient providing discomfort, however, the end pillows should not be too large so as not to fit against one's neck and chin when placed in the affixing surface of the main pillow body 104 position. An affixing surface 126 may be a positive or negative VELCRO or other affixing material, such as a metal/magnet, snap button, etc.

The main pillow is approximately 3.75 to 4 inches in diameter. The pillow extensions are approximately the same in diameter as the main pillow. However, the end pillows could be larger in diameter than the main pillow. There may be three to six, or even more, affixing surfaces (VELCRO and/or magnets and/or snap buttons), for example purposes, VELCRO will be described. In one example, one of the affixing surfaces will be VELCRO hooks (i.e., the underside of the extension pillow), then two will be soft VELCRO carpet, the affixing surface 104 on the main body 102 and the affixing surfaces 126 on the end of the main body. The flat portion of the pillow extensions will be VELCRO hooks (i.e., the rough side of VELCRO). The affixing surface on the main pillow 102 is VELCRO carpet, and the surface on the pillow ends is VELCRO hooks so the carpet is the part that comes into contact with a user's face. The third affixing surface is also VELCRO carpet on a top surface of right and left angled sections of the main pillow, about 1-inch inward from an end of the main pillow and near where a user's jaw and chin are located.

In an alternative example, there may be additional affixing surfaces to support the extensions with support straps so they do not fall off the main body if the primary affixing surface is compromised. Both the main pillow and extensions should be some type of memory foam or sponge elastic material. There may also be a rigid circular plate that is placed in the end of the main body of the pillow and the end of the pillow extensions to cause the affixing surfaces to meet and join in a cohesive and substantially uniform manner without deflation or deformation.

Figure 4:
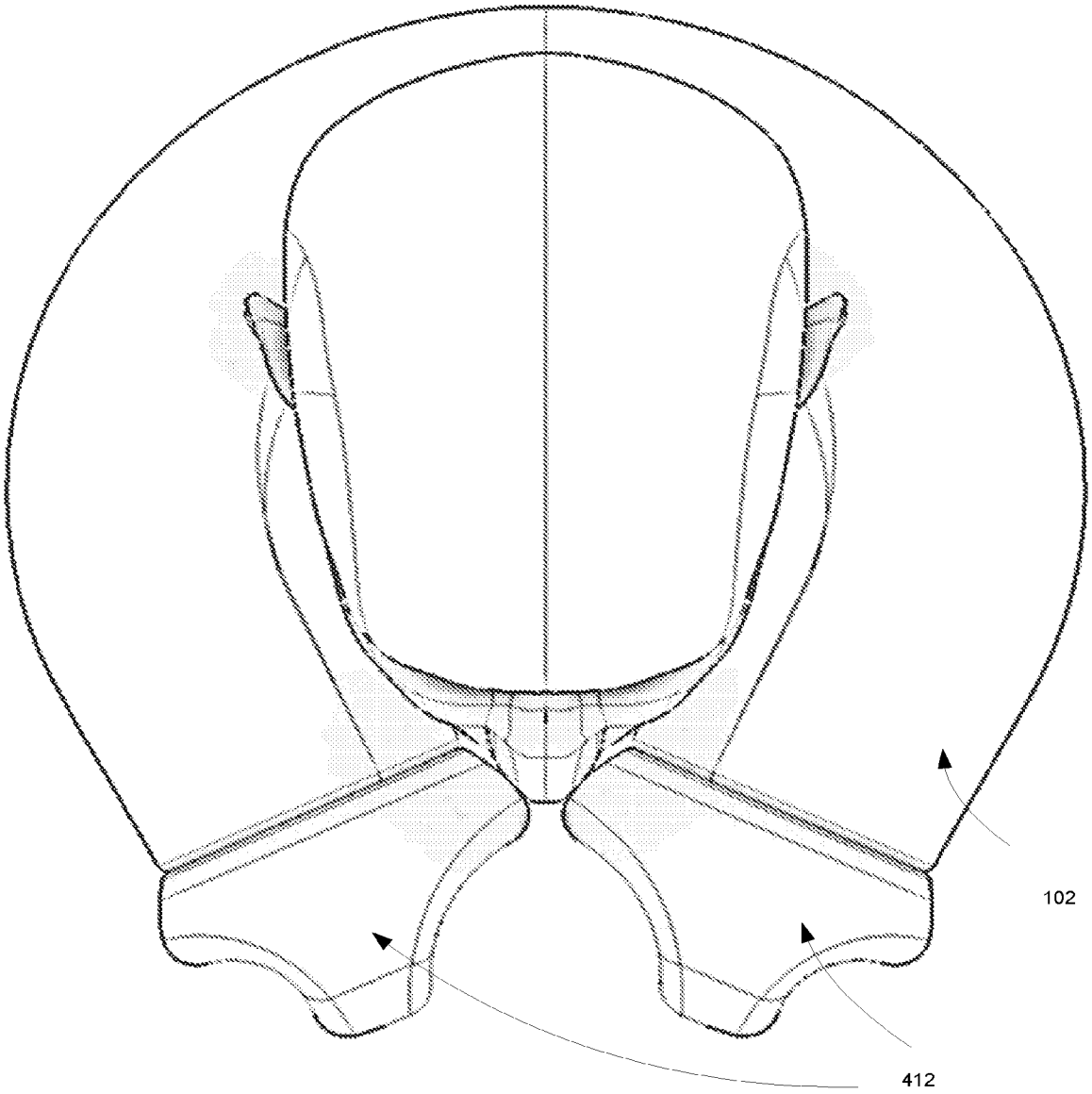
FIG. 4 illustrates a top view of an alternative embodiment of having a main pillow with contoured end pieces.

FIG. 4 illustrates a top view of the alternative embodiment of having a main pillow with contoured end pieces. In this configuration, the main pillow 102 and end pieces 412 are generally the same size, however, the end pieces have a contoured edge that causes an arcuate angle to form on one or more sides of the end piece. The double contoured end piece 412 in this example has a double contoured arcuate-angled cut-out portion. The one cut-out that is smaller and has a steeper arcuate angle may be for people with longer necks and smaller jaws, such as women. The larger contour may be for people with larger chins or jaws and those which may have a shorter neck. Once the end pieces 412 are removed and placed on the top portions of the pillow via VELCRO or some other affixing mechanism, then the pillow extensions provide a vertical support that offers a support in an extended vertical direction instead of just the support offered by the main pillow body.

Figure 5:
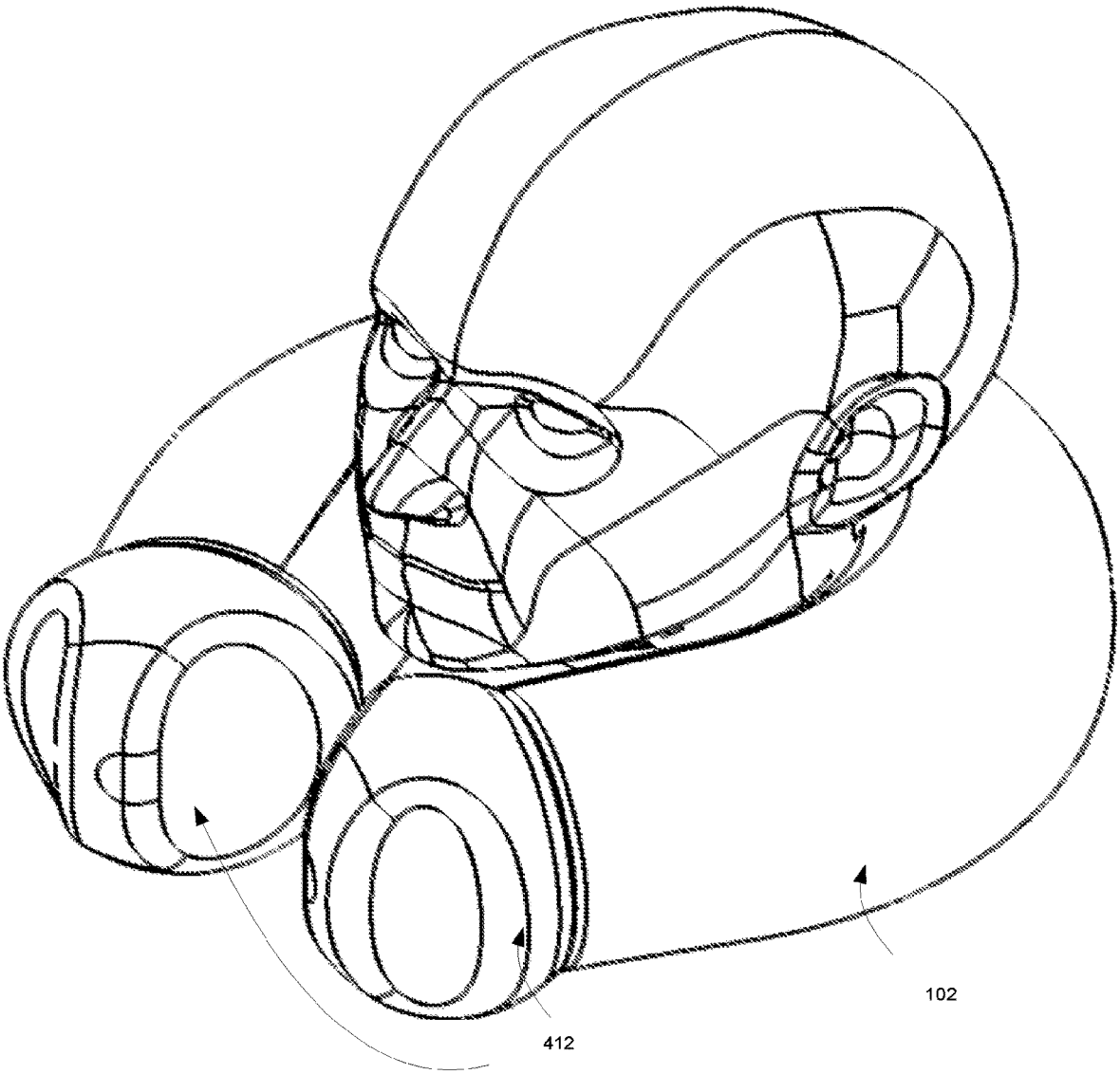
FIG. 5 illustrates a side view of the alternative embodiment of having a pain pillow with contoured end pieces.

FIG. 5 illustrates a side view of the alternative embodiment of having a pain pillow with contoured end pieces. Referring to FIG. 5, the double contoured end piece 412 may be a single contoured end piece with one contoured/arcuately angled section that deviates from the regular rounded end by cutting a portion of the rounded edge away to provide the contoured surface.

Figure 6:
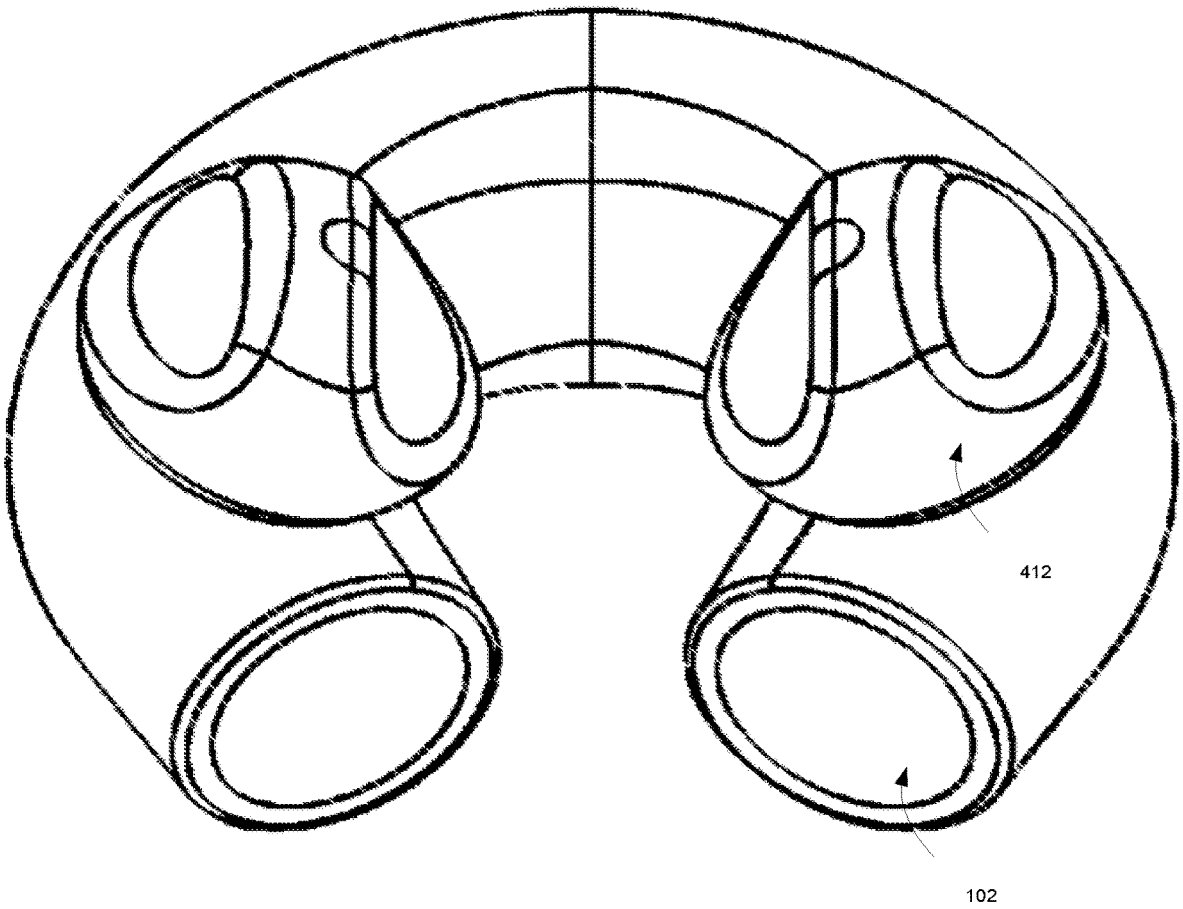
FIG. 6 illustrates a front view of the alternative embodiment of having a main pillow with contoured end pieces which have been removed from the end portions of the main pillow body and have been affixed to the upper portion of the main pillow body.

FIG. 6 illustrates a front view of the alternative embodiment of having a main pillow 102 with contoured end pieces 412, which have been removed from the end portions of the main pillow body 102 and have been affixed to the upper portion of the main pillow body. In this example, the end pieces 412 have been removed from the main pillow body 102. The double contoured end pieces 412 are then placed on top of the main pillow body and may be affixed by an affixing surface (VELCRO, magnets, etc.).

Figure 7:
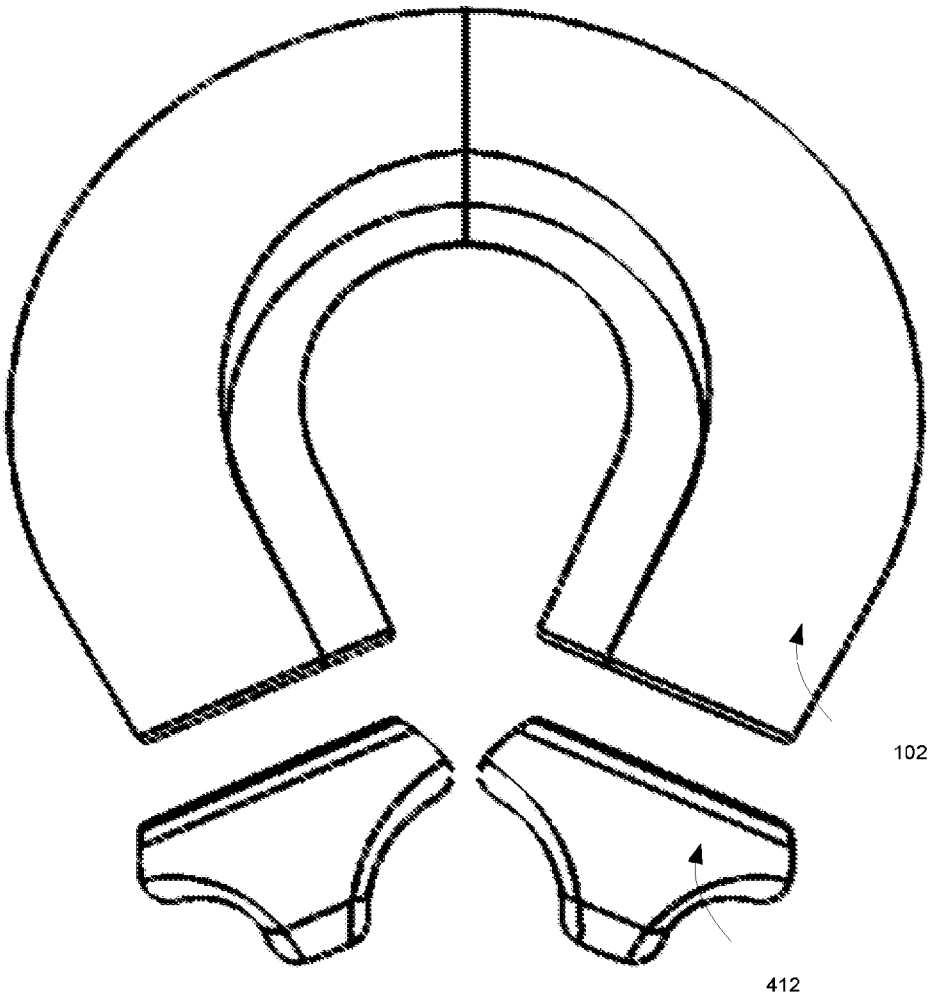
FIG. 7 illustrates a top view of the alternative embodiment of having a main pillow with the contoured end pieces separated.

FIG. 7 illustrates a top view of the alternative embodiment of having a main pillow with contoured end pieces. In this example, the pillow and end pieces demonstrate an exploded example where the ends 412 are removed.

Figure 8:
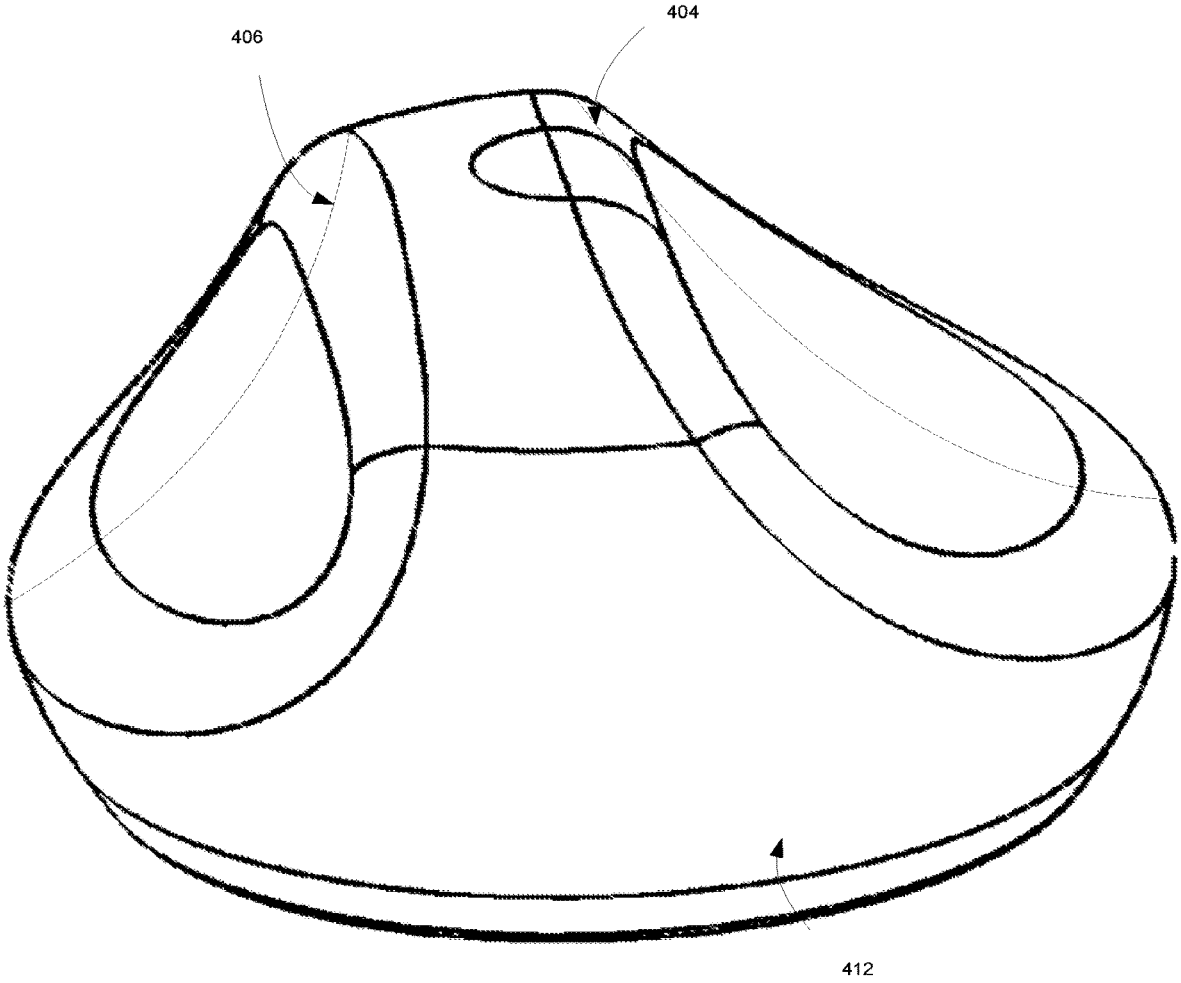
FIG. 8 illustrates a side view of one of the contoured end pieces.

FIG. 8 illustrates a side view of the contoured end piece. Referring to FIG. 8, the contoured edge on one side has a larger arcuate distance 404 but a smaller angle with regard to the steepness of the arcuate surface with respect to the resting surface. The smaller arcuate contour 406 is shorter than that of the other side 404, however, the steepness angle is greater and thus the arcuate angle is larger with respect to the resting surface.

One example embodiment is a pillow with a main pillow body and one or more separatable pillow body extensions affixed to the main pillow body by an affixing surface on one or more ends of the main pillow body. The main body has additional affixing surfaces on a different surface portion of the main body than the one or more ends of the main pillow body. The one or more pillow body extensions have one or more cut-out portions which are contoured and arcuately shaped. The cut-out portions provide a deformity to rest against a human face when the extensions are engaged in an upward direction, with respect to the pillow body, and by being affixed to the additional affixing surfaces. The pillow body is substantially cylindrical. Each of the one or more cut-out portions includes two cut-out portions, such that a first cut-out portion has a shorter arcuate cut-out distance than the second cut-out portion. The first cut-out portion has a steeper sloped-angle than a sloped-angle of the second cut-out portion.

Another example embodiment includes a substantially cylindrical main pillow body loop with an opening where both ends of the main pillow body end, and separatable pillow body extensions affixed to the main pillow body at both ends of the main pillow body.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the application.

While preferred embodiments of the present application have been described, it is to be understood that the embodiments described are illustrative only and the scope of the application is to be defined solely by the appended claims when considered with a full range of equivalents and modifications thereto.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the invention.

One having ordinary skill in the art will readily understand that the application as discussed above may include elements in configurations that are different than those which are disclosed. Therefore, although the application has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

What is claimed is:

1. A pillow comprising:

a cylindrical U-shaped main pillow body with two ends each comprising respective affixing surfaces on surfaces of the two ends, wherein the affixing surfaces comprise an affixing material different from a material of the main pillow body, and wherein a top portion of the U-shaped main pillow body further comprises additional affixing surfaces of the affixing material on two sides of the top portion of the U-shaped main pillow body; and two separatable pillow extensions affixed to the U-shaped main pillow body at the respective affixing surfaces on the two ends of the U-shaped main pillow body or affixed to the additional affixing surfaces, wherein the two pillow extensions each have one or more contoured and arcuately shaped surface deformity portions that deviate inwardly from regular rounded end portions of the two pillow extensions, and wherein the two pillow extensions are larger in diameter than the main pillow body.

2. The pillow of claim 1, wherein the one or more contoured and arcuately shaped surface deformity portions comprises two contoured and arcuately shaped surface deformity portions on each of the pillow extensions, wherein a first portion has a shorter arcuate curved distance than a second curved portion.

3. The pillow of claim 2, wherein the first portion has a steeper sloped-angle than a sloped-angle of the second curved portion.

* * * * *